US012139834B2

(12) United States Patent
Ishii

(10) Patent No.: US 12,139,834 B2
(45) Date of Patent: Nov. 12, 2024

(54) EMBROIDERY SYSTEM

(71) Applicant: Yoko Ishii, Kanagawa (JP)

(72) Inventor: Yoko Ishii, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/203,657

(22) Filed: May 31, 2023

(65) Prior Publication Data

US 2023/0392312 A1 Dec. 7, 2023

(30) Foreign Application Priority Data

Jun. 3, 2022 (JP) ..... 2022-091084

(51) Int. Cl.
*D05C 5/02* (2006.01)
*D05C 11/24* (2006.01)
*D05C 13/02* (2006.01)

(52) U.S. Cl.
CPC ..... *D05C 5/02* (2013.01); *D05C 11/24* (2013.01); *D05C 13/02* (2013.01)

(58) Field of Classification Search
CPC ..... D05C 5/02; D05C 11/24; D05B 19/08; D05B 19/10; D05B 19/12
See application file for complete search history.

(56) References Cited

U.S. PATENT DOCUMENTS 6,189,989 B1 * 2/2001 Hirabayashi ..... D05C 11/24 427/288
2021/0197557 A1 7/2021 Yamaguchi
2022/0034008 A1 * 2/2022 Eklind ..... D05B 67/00
2022/0120001 A1 * 4/2022 Vlandis ..... D05B 19/12

FOREIGN PATENT DOCUMENTS

JP 5-272046 10/1993
JP 2009-273675 11/2009
JP 2021-102341 7/2021

* cited by examiner

*Primary Examiner* — Nathan E Durham
(74) *Attorney, Agent, or Firm* — XSENSUS LLP

(57) ABSTRACT

An embroidery system includes a coloring device to color a thread. The embroidery system includes an embroidery device to perform embroidery of an embroidery design and underlay stitching. The embroidery device uses the thread colored by the coloring device for at least one of the embroidery of the embroidery design or the underlay stitching. The embroidery system includes circuitry to: create data of the embroidery design and the underlay stitching according to embroidery image data; create color data for coloring the thread to be used for coloring the at least one of the embroidery of the embroidery design or the underlay stitching; acquire roughness data representing roughness impression of the embroidery image data; and change an embroidery density of the embroidery design according to the roughness data.

15 Claims, 9 Drawing Sheets

EMBROIDERY SYSTEM

CROSS-REFERENCE TO RELATED APPLICATION

This patent application is based on and claims priority pursuant to 35 U.S.C. § 119(a) to Japanese Patent Application No. 2022-091084, filed on Jun. 3, 2022, in the Japan Patent Office, the entire disclosure of which is hereby incorporated by reference herein.

BACKGROUND

Technical Field

Embodiments of the present disclosure relate to an embroidery system.

Related Art

Embroidery is performed using threads of a plurality of colors to form various designs with high decorative properties on fabric. In the related art, when a design of a plurality of colors is to be embroidered on fabric, embroidery pattern information has to be created for each color and a thread has to be replaced according to a specific color. For this reason, a large-sized embroidery apparatus is to be used that holds threads of a plurality of colors.

SUMMARY

An embodiment of the present disclosure includes an embroidery system. The embroidery system includes a coloring device to color a thread. The embroidery system includes an embroidery device to perform embroidery of an embroidery design and underlay stitching. The embroidery device uses the thread colored by the coloring device for at least one of the embroidery of the embroidery design or the underlay stitching. The embroidery system includes circuitry to: create data of the embroidery design and the underlay stitching according to embroidery image data create color data for coloring the thread to be used for coloring the at least one of the embroidery of the embroidery design or the underlay stitching; acquire roughness data representing roughness impression of the embroidery image data; and change an embroidery density of the embroidery design according to the roughness data.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
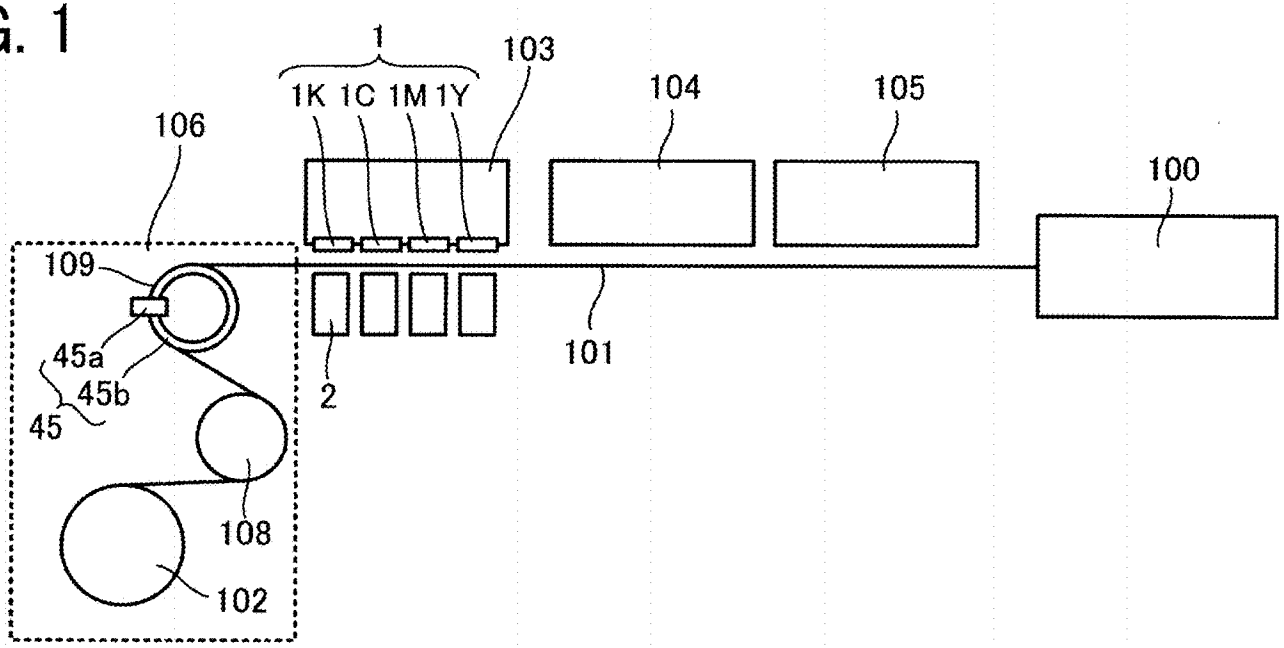
FIG. 1 is a schematic view of a configuration of an embroidery system, according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

With reference to the drawings, a description is now given of an embroidery system according to an embodiment of the present disclosure. Embodiments of the present disclosure are not limited to embodiments hereinafter described, and changes such as other embodiments, additions, modifications, and deletions may be made within the scope conceivable by those skilled in the art. Any aspects are included in the scope of the present disclosure as long as the actions and effects of the present disclosure are exhibited.

Figure 2:
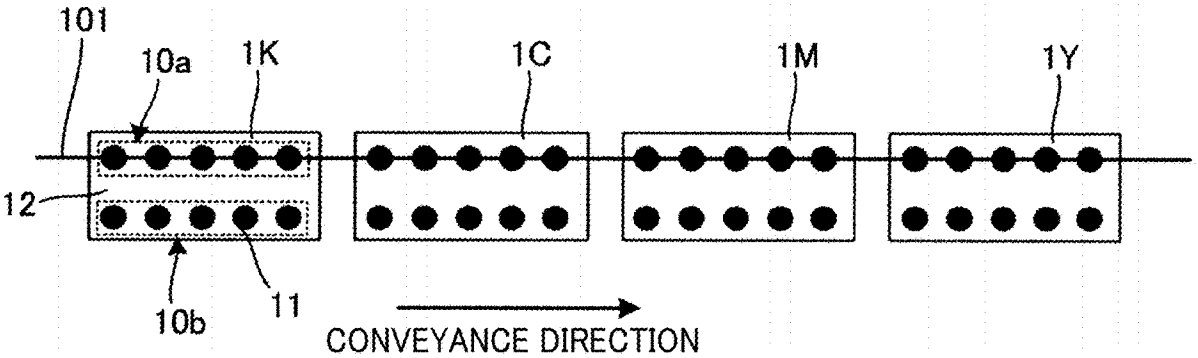
FIG. 2 is a schematic view of a lower face of a liquid applying device of a liquid discharge apparatus that the embroidery system includes, according to an embodiment of the present disclosure.

FIG. 1 is a schematic view of a configuration of an embroidery system according to an embodiment of the present disclosure. FIG. 2 is a schematic view of a lower face of a liquid applying device of a liquid discharge apparatus 103 that the embroidery system of FIG. 1 includes.

The embroidery system of the present embodiment includes a thread feeding apparatus 106, a liquid discharge apparatus 103, a drying apparatus 104, a post-processing apparatus 105, and an embroidery apparatus 100.

The thread feeding apparatus 106 includes a supply reel 102 around which a thread 101 is wound. The thread 101 is fed out from the supply reel 102 is guided by a conveyance roller 108 and a conveyance roller 109 and continuously routed to the embroidery apparatus 100.

The conveyance roller 109 is provided with a rotary encoder 45. In the following description, the rotary encoder 45 may be referred to simply as encoder. The rotary encoder 45 includes an encoder wheel 45*b* that rotates together with the conveyance roller 109 and an encoder sensor 45*a* that reads a slit of the encoder wheel 45*b*.

The liquid discharge apparatus 103 includes a plurality of heads 1 (1K, 1C. 1M, and 1Y) and a maintenance unit 2. The liquid discharge apparatus 103 discharges a liquid of a required color onto the thread 101 that is drawn out from the supply reel 102 and conveyed. The maintenance unit 2 includes a plurality of individual maintenance units to perform maintenance of the heads 1 (1K, 1C, 1M, and 1Y), respectively. A color of the liquid to be discharged is determined according to color data created according to an embroidery image.

In the present embodiment, the liquid is ink. In the following description, an operation of applying ink to a thread is also referred to as "coloring," "dyeing," "printing," for example.

Referring to FIG. 2, in the liquid discharge apparatus 103, the plurality of heads 1K, 1C, 1M, and 1Y discharges different colors respectively. For example, the head 1K discharges droplets (ink droplets) of black (K), the head 1C discharges droplets of cyan (C), the head 1M discharges droplets of magenta (M), and the head 1Y discharges droplets of yellow (Y). The above-described order of colors is merely one example. In some embodiments, the colors may be arranged in an order different from the above-described order. Alternatively, one or more different heads are added to the heads 1 or replaced with one or more of the heads 1, the one or more different heads discharging ink of a special color such as orange or green, or an overcoat treatment liquid that imparts glossiness to the surface of the thread, for example.

The head 1K has a nozzle surface 12 on which a nozzle row 10*a* and a nozzle row 10*b* are formed. A plurality of nozzles 11 that discharges liquid droplets is arranged in each of the nozzle row 10*a* and the nozzle row 10*b*. Each of the heads 1K, 1C, 1M, and 1Y is disposed such that the direction of each nozzle row (i.e., the arrangement of the nozzles 11 in each nozzle row) is parallel to the thread conveyance direction (thread feeding direction) of the thread 101.

In the head 1K, ink droplets discharged from the nozzles 11 of one row (e.g., the nozzle row 10*a* in FIG. 2) positioned directly above the thread 101 land on the thread 101 to color (also referred to as dye or print) the thread 101.

FIG. 2 illustrates an example in which the head 1 has two nozzle rows, i.e., the nozzle row 10*a* and the nozzle row 10*b*, on the nozzle surface 12. Alternatively, the number of nozzle rows in the head 1K may be one, or three or more. As illustrated in FIG. 2, the heads 1C, 1M, and 1Y also have the same or substantially the same configurations as the configuration of the head 1K.

Each of the nozzle row 10*a* and the nozzle row 10*b* includes a nozzle group in which the nozzles 11 are arranged in a conveyance direction of the thread 101.

When printing is performed on the thread 101, one nozzle row is used.

When a plurality of nozzle rows is arranged in the head 1 as illustrated in FIG. 2, one nozzle row used for printing may be appropriately switched among the plurality of nozzle rows. For example, after printing is performed for a certain time period by one nozzle row (e.g., the nozzle row 10*a*, which is a first nozzle row), the head 1 is moved in the direction orthogonal to the conveyance direction of the thread 101. Thus, printing can be performed by another nozzle row (e.g., the nozzle row 10*b*, which is a second nozzle row) switched from the one nozzle row.

Referring again to FIG. 1, the drying apparatus 104 performs a fixing process (drying process) on the thread 101 to which liquid discharged from the liquid discharge apparatus 103 is applied. The drying apparatus 104 includes a heater such as a pressurizing/heating type heater or a hot air blowing type heater. The drying apparatus 104 the thread 101 to dry the thread.

The post-processing apparatus 105 includes, for example, a cleaner that cleans ink that is not fixed on the thread 101, a tension adjuster that adjusts the tension of the thread 101, a feed amount detector that detects the amount of movement of the thread 101, and a lubricant applicator that lubricates the surface of the thread 101.

The embroidery apparatus 100 sews the thread 101 into a cloth according to embroidery data, to embroider a pattern such as a design or a pattern on the cloth. The embroidery apparatus 100 uses the thread 101 colored by the liquid discharge apparatus 103 for at least one of embroidery of an embroidery design and underlay stitching.

In a case in which the embroidery apparatus 100 is located at a different place (in a case in which the embroidery apparatus 100 is not an in-line type), instead of the embroidery apparatus 100, a winder to wind the thread 101 to which liquid has been applied may be coupled to a subsequent stage of the post-processing apparatus 105. In this case, the thread once wound is carried to a location where a processing apparatus is located and loaded into the processing apparatus, and thus desired processing is performed on the thread.

Alternatively, another processing apparatus such as a sewing machine may be coupled to the subsequent stage of the post-processing apparatus 105.

In the present embodiment, examples of the thread 101 as a discharge receive medium, include glass fiber thread, wool thread, cotton thread, synthetic fiber thread, metallic thread, mixed thread of wool, cotton, polymer or metal, and linear object (linear member and continuous base materials) to which liquid can be applied. Examples of the thread 101 also includes braided cord and flatly braided cord. In addition to the linear object, examples of the discharge receive medium that can be colored (dyed) by ink droplets further include band-shaped members (continuous base materials) such as rope, cable, and cord to which liquid can be applied. Each of the discharge receive media is a linear or band-shaped medium having a narrow width and being continuous in the conveyance direction.

In the liquid discharge apparatus 103, it is assumed that liquid droplets discharged from the nozzles 11 of the respective colors are discharged once to complete discharge operation to the discharge receive medium. Accordingly, the thread 101 as the discharge receive medium may have a width, so that, for example, when a liquid droplet is discharged from each nozzle and lands on the discharge receive medium, the liquid droplet bleeds over at least ½ or more of the width of the discharge receive medium, preferably, the liquid droplet bleeds over substantially the whole widthwise area of the discharge receive medium.

A description is now given of a hardware configuration of the embroidery system, according to the present embodiment.

Figure 3:
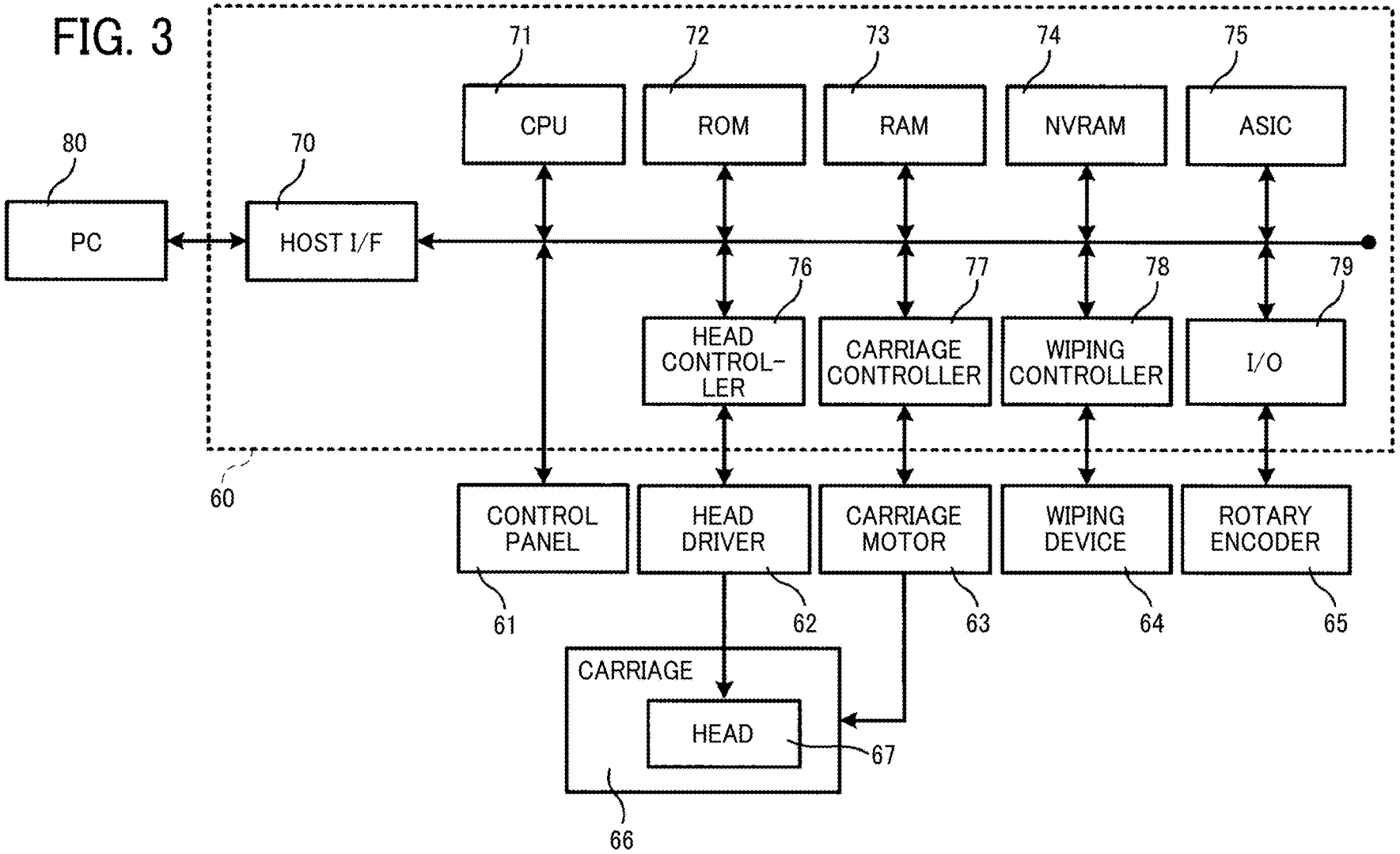
FIG. 3 is block diagram illustrating an example of a hardware configuration of the liquid discharge apparatus that the embroidery system includes, according to an embodiment of the present disclosure.

FIG. 3 is a block diagram illustrating an example of a hardware configuration of a liquid discharge apparatus 103 that the embroidery system includes, which is a controller 60 of the embroidery system.

The controller 60 includes a central processing unit (CPU) 71, a read only memory (ROM) 72, a random access memory (RAM) 73, a non-volatile random access memory (NVRAM) 74, and an application specific integrated circuit (ASIC) 75. The controller 60 further includes a host interface (I/F) 70, a head controller 76, a carriage controller 77, a wiping controller 78, and an input/output (I/O) 79, which are connected with each other via a data bus.

The data bus allows the components of the controller 60 to communicate bidirectionally. The data bus transfers data.

The CPU 71 controls operations of the embroidery system. For example, the CPU 71 executes various control programs stored in the ROM 72 with the RAM 73 as a working area, to output control commands for controlling operations in the embroidery system.

The ROM 72 is a nonvolatile semiconductor memory that stores the programs executed by the CPU 71 and other fixed data such as basic input/output system (BIOS), operating system (OS) settings, or network settings. The RAM 73 is a volatile semiconductor memory that temporarily stores programs and data. The NVRAM 74 is a nonvolatile rewritable semiconductor memory that holds data while the power supply of the apparatus is turned off. The ASIC 75 performs various signal processing with respect to image data, image processing such as sorting, and input/output signal processing to control the entire apparatus.

The host I/F 70 transmits and receives data and signals to and from a host such as a personal computer (PC) 80.

The head controller 76 generates a driving waveform for driving the heads 1 of the liquid discharge apparatus 103. Further, the head controller 76 transmits color data and associated data for driving a pressure generator of each of the heads 1 to a head driver.

The carriage controller 77 controls driving of a carriage motor.

The wiping controller 78 controls driving of each wiping device 64 provided in the maintenance unit 2.

The I/O 79 receives a detection pulse from the rotary encoder 45 provided on the conveyance path of the thread 101 and detection signals from other various sensors.

The control panel 61 inputs and displays information.

The host I/F 70 of the controller 60 receives data generated by the PC 80 through a cable or a network. The CPU 71 reads data from a reception buffer of the host/F 70 and analyzes the read data. The ASIC 75 performs, for example, image processing and data rearrangement processing with respect to a result of the analysis by of the CPU 71. The CPU 71 transmits a result of the processing by the ASIC 75 to the head controller 76. The head controller 76 transmits the color data and the driving waveform to the head driver 62 at a required timing.

Alternatively or additionally, data (embroidery data, color data, roughness data) for image output may be generated by storing the data in the ROM 72, for example. Still alternatively or additionally, the host (the PC 80) may expand the data into bitmap data and transfer the bitmap data to the embroidery system.

In response to receiving the color data and the driving waveform from the head controller 76, the head driver 62 selectively applies driving pulses to the pressure generator of the head 1, to drive the heads 1.

Figure 4:
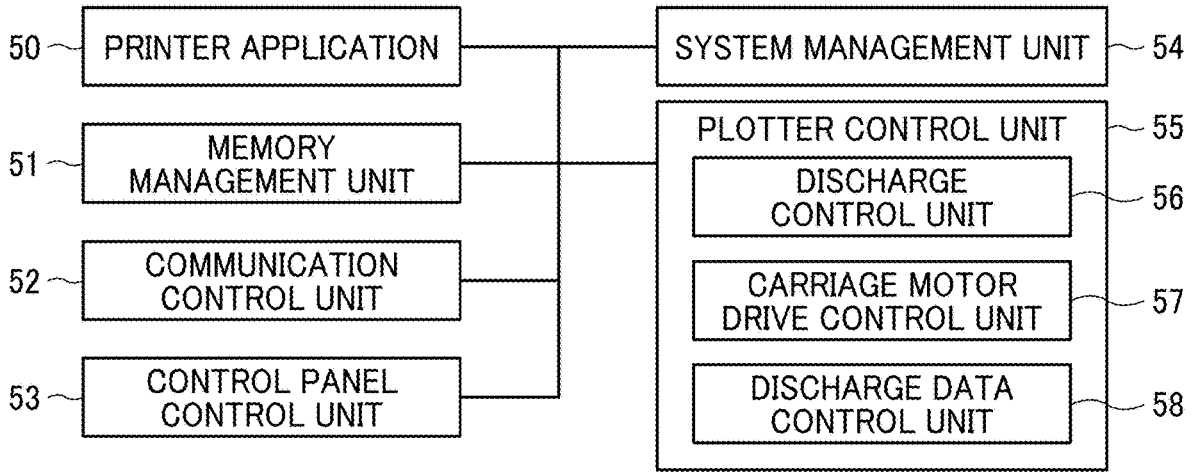
FIG. 4 is block diagram illustrating an example of a functional configuration of the liquid discharge apparatus that the embroidery system includes, according to an embodiment of the present disclosure.
Figure 5:
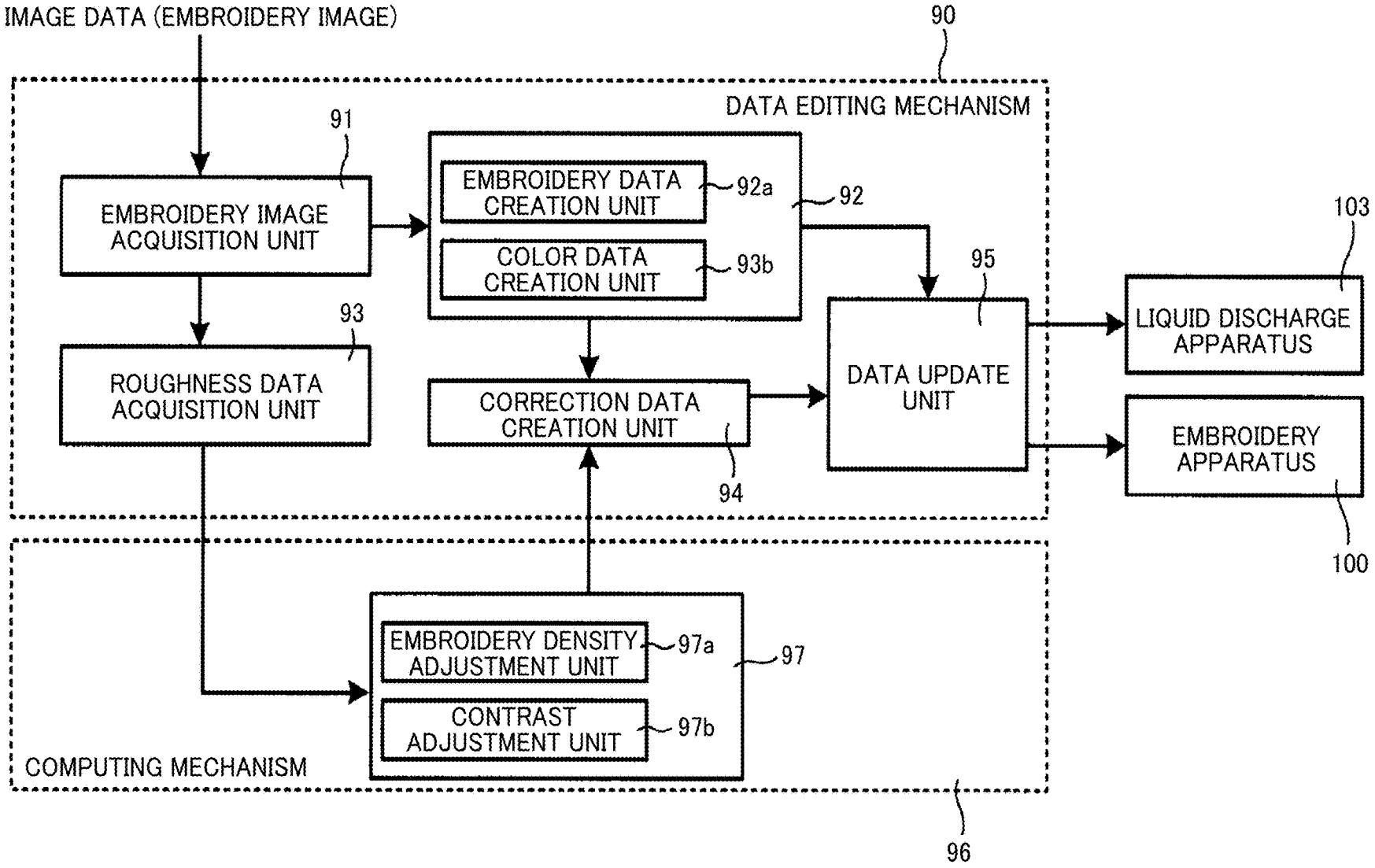
FIG. 5 is a block diagram illustrating examples of functional configurations of a data editing mechanism and a computing mechanism of the embroidery system, according to an embodiment of the present disclosure.

FIG. 4 and FIG. 5 are block diagrams illustrating examples of a functional configuration of the embroidery system, according to the present disclosure.

Units in the block diagrams are functions that are implemented by or that are caused to function by operating one or more of the components illustrated in FIG. 3 in cooperation with instructions of the CPU 71 according to the program expanded to the RAM 73.

FIG. 4 is a block diagram illustrating a functional configuration of the liquid discharge apparatus 103 of the embroidery system. The liquid discharge apparatus 103 discharges liquid from each of the nozzles 11 of the head 1 according to color data that the liquid discharge apparatus acquires.

As illustrated in FIG. 4, the liquid discharge apparatus 103 includes a printer application 50, a memory management unit 51, a communication control unit 52, a control panel control unit 53, a system management unit 54, and a plotter control unit 55.

The printer application 50, which is mainly implemented by processing of the CPU 71, performs control relating to a printer function.

The memory management unit 51, which is mainly implemented by processing of the CPU 71, manages the RAM 73.

The communication control unit 52 is implemented by the host I/F 70, when operating according to instructions of the CPU 71. The communication control unit 52 enables the liquid discharge apparatus 103 to communicate with the PC 80 through a communication network, for example.

The control panel control unit 53 is implemented by the control panel 61, when operating according to instructions of the CPU 71. The control panel control unit 53 performs display on the control panel 61 and receives input information from the control panel 61.

The system management unit 54, which is mainly implemented by processing of the CPU 71, manages the NVRAM 74 and nonvolatile setting values.

The plotter control unit 55, which is mainly implemented by processing of the CPU 71, controls hardware relating to coloring of the thread 101. Further, the plotter control unit 55 includes a discharge control unit 56, a carriage motor drive control unit 57, and a discharge data control unit 58.

The discharge control unit 56 controls the head controller 76 illustrated in FIG. 3. The discharge control unit 56 performs, for example, dummy discharge processing, management control of the dummy discharge interval, and change instruction control of a liquid discharge position for the dummy discharge. Further, the discharge control unit 56 performs, for example, cleaning processing of the heads 1, management control of the cleaning interval, and change instruction control of a head position for the cleaning.

The carriage motor drive control unit 57 controls the carriage controller 77 illustrated in FIG. 3. For example, the carriage motor drive control unit 57 controls the movement of the carriage 66 to a capping position, a wiping position, a dummy discharge position, and a print position.

The discharge data control unit 58 stores discharge data in the RAM 73 while the carriage 66 moves. Further, the discharge data control unit 58 processes the stored discharge data when the carriage 66 stops moving, and performs synthesis processing of the processed stored discharge data and the discharge data.

The embroidery system according to the present disclosure includes the liquid discharge apparatus 103 as an example of a coloring means for coloring the thread 101. The embroidery system further includes the embroidery apparatus 100 as an example of an embroidery means for performing an embroidery of embroidery design and underlay stitching. The embroidery apparatus 100 is the embroidery means that uses the thread 101 colored by the liquid discharge apparatus 103 for at least one of the embroidery of the embroidery design and the underlay stitching. The embroidery system includes an embroidery data creation means for creating data of the embroidery design and the underlay stitching according to an embroidery image. The embroidery system includes a color data creation means for creating color data for coloring the thread 101. The embroidery system includes an embroidery density adjustment means for acquiring roughness data representing roughness impression of the embroidery image and changing an embroidery density of the embroidery design according to the roughness data.

FIG. 5 is a block diagram illustrating functional configurations of a data editing mechanism 90 and a computing mechanism 96 of the embroidery system, according to the present disclosure.

The embroidery system of the present embodiment includes the data editing mechanism 90 and the computing mechanism 96. Each of the data editing mechanism 90 and the computing mechanism 96 is a controller. Each of the data editing mechanism 90 and the computing mechanism 96 is implemented by an information processing device such as the CPU 71 or the ASIC 75 illustrated in FIG. 3.

The data editing mechanism 90 includes an embroidery image acquisition unit 91, a data creation unit 92, a roughness data acquisition unit 93, a correction data creation unit 94, and a data update unit 95. The data creation unit 92 includes an embroidery data creation unit 92*a* and a color data creation unit 92*b*. The embroidery data creation unit 92*a* is an example of embroidery data creation means. The color data creation unit 92*b* is an example of color data creation means. The roughness data acquisition unit 93 is an example of roughness data acquisition means. The embroidery image acquisition unit 91 acquires an embroidery image (embroidery file), which is image data.

The computing mechanism 96 includes an embroidery density adjustment unit 97*a* and a contrast adjustment unit 97*b*. The embroidery density adjustment unit 97*a* is an example of embroidery density adjustment means. The contrast adjustment unit 97*b* is an example contrast adjustment means.

In the embroidery system according to the present embodiment, the data editing mechanism 90 and the computing mechanism 96 modifies the embroidery data and the color data according to the roughness data acquired from the embroidery image. The embroidery system performs embroidery using the embroidery data and the color data that are updated to the modified data, to impart a visual roughness impression (pseudo three-dimensional effect) to the embroidery design. The visual roughness impression can be imparted by, for example, controlling the embroidery density of the embroidery design so that underlay stitching can be seen through. Alternatively or additionally, the visual roughness impression can be imparted by increasing the color contrast between the embroidery design and the underlay stitching.

The embroidery data creation unit 92*a* creates embroidery data (initial embroidery data) according to the acquired embroidery image.

The term "embroidery data" refers to data that is input to the embroidery apparatus 100. The embroidery data includes data in which data of coordinates at which the needle of the embroidery apparatus 100 is moved is associated with data indicating what is to be executed at the corresponding coordinates. Examples of what is to be executed at the corresponding coordinate include operation such as: (1) inserting the needle into the cloth to catch the upper thread and then returning the needle to the surface of the cloth; (2) after the operation of (1), moving the needle to the next position at which the needle is to inserted; (3) ending the embroidery or cutting the thread to switch the needle to another needle or to move the needle to a different place where the embroidery is not continuous; and (4) moving the needle to an initialization position (e.g., a position where alignment is to be performed.

The embroidery data is data that includes information on the coordinates at which the needle is moved and the operation to be performed at the corresponding coordinates as described above, and includes neither roughness information nor color information.

In creating the embroidery data, in addition to the embroidery design, which is a design appearing on the surface, data for underlay stitching is also created. The underlay stitching prevents a cloth from shrinking, although the underlay stitching is usually hidden by the embroidery design.

Figure 6:
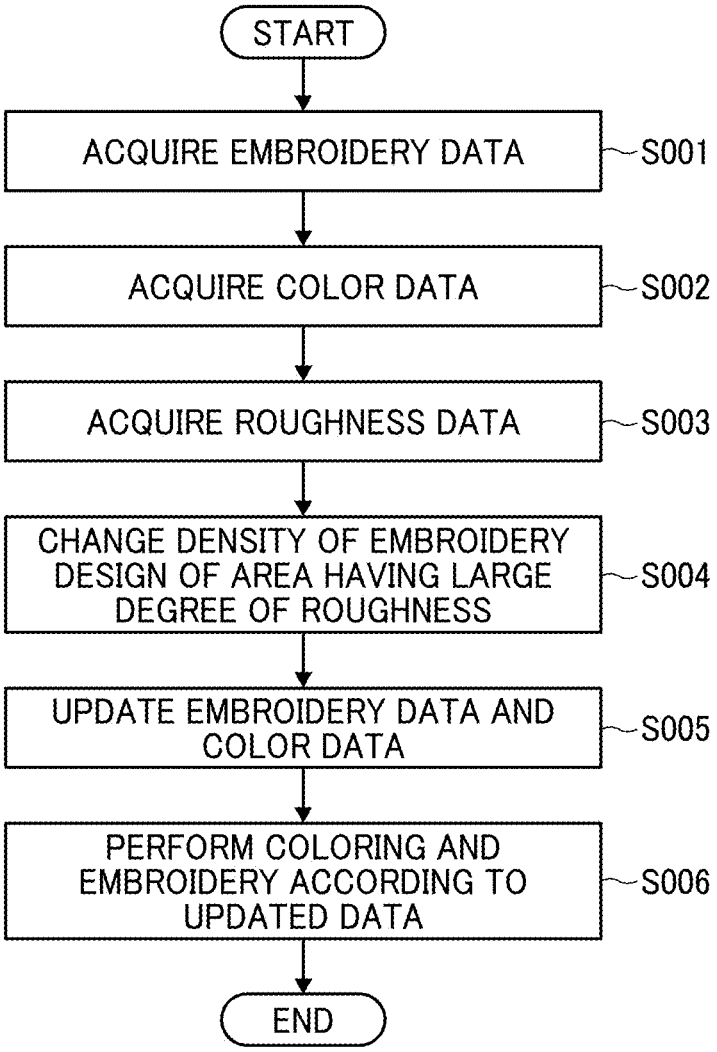
FIG. 6 is a flowchart illustrating an operation of the embroidery system in a first mode, according to an embodiment of the present disclosure.

Although a description provided with reference FIG. 6 is of an example in which the data editing mechanism 90 creates the initial embroidery data according to the embroidery image, in another example, the initial embroidery data may be directly input from extraneous sources.

The color data creation unit 92*b* creates color data for coloring the thread 101 according to the acquired embroidery image.

The term "color data" refers to data for coloring (dyeing) the thread 101 at the liquid discharge apparatus 103. The color data includes data that designates which area along the length direction of the thread 101 is to be colored with what color. The liquid discharge apparatus 103 connected to the embroidery system colors the thread 101 according to the color data.

The thread 101 colored by the liquid discharge apparatus 103 may be used for only one of the embroidery of the embroidery design and the underlay stitching, and a thread of a desired color not colored by the liquid discharge apparatus 103 may be used for the other one of the embroidery of the embroidery design and the underlay stitching.

The roughness data acquisition unit 93 acquires roughness data of the image data.

The term "roughness data" is information relating to a visual roughness impression (three-dimensional effect) of the surface of a design (pattern), which is the embroidery image. In other words, the "roughness data" is data relating to a visual effect that provides such a roughness impression.

Examples of roughness data include surface roughness data that can be obtained by scanning a motif of the embroidery image with a three-dimensional (3D) scanner, texture data or data of contrast in an image of the embroidery image (e.g., a design image). Alternatively or additionally, a frequency of the image of the embroidery image may be calculated for each desired area, and data based on the distribution of the magnitudes of the calculated frequencies may be used. Alternatively or additionally, a user may set the roughness data.

In the present embodiment, the embroidery system includes the embroidery density adjustment unit 97*a* and the contrast adjustment unit 97*b*. The embroidery density adjustment unit 97*a* changes an embroidery density of the embroidery design on the basis of the roughness data obtained by the roughness data acquisition unit 93. The contrast adjustment unit 97*b* changes a contrast between a color of a thread used for embroidering the embroidering design and a color of a thread used for underlay stitching on the basis of the roughness data obtained by the roughness data acquisition unit 93.

The roughness data acquisition unit 93 extracts an area in which a degree of roughness of the embroidery image is large. The embroidery density adjustment unit 97*a* performs processing of reducing the embroidery density of the embroidery design corresponding to the area where the degree of roughness is large. The correction data creation unit 94 modifies the embroidery data and the color data according to the reduced embroidery density. Whether it is a large degree of roughness is determined based on a reference degree of roughness that is previously set.

The term "degree of roughness" refers to a degree of visual roughness impression (three-dimensional effect) of the surface of a design (pattern). The greater the degree of roughness, the greater the visual roughness impression (three-dimensional effect).

The contrast adjustment unit 97*b* performs processing of increasing a contrast between a color of the thread 101 used for embroidering the embroidery design corresponding to the area where the degree of roughness is large and a color of the thread 101 used for underlay stitching. The correction data creation unit 94 modifies the color data according to the increased contrast.

The contrast adjustment unit 97*b* may perform processing of increasing a difference in brightness between a color of the thread 101 used for embroidering the embroidery design corresponding to the area where the degree of roughness is large and a color of the thread 101 used for underlay stitching. In this case also, the correction data creation unit 94 modifies the color data.

The embroidery data and the color data before the modification and the embroidery data and the color data after the modification are input to the data update unit 95. In a case that a roughness impression is to be given to the embroidery design, the update unit 95 sends the embroidery data and/or the color data that are modified according to the roughness data to the liquid discharge apparatus 103 and the embroidery apparatus 100.

FIG. 6 is a flowchart illustrating a first mode of a flow of embroidery by the embroidery system, according to the present embodiment.

First, the embroidery system acquires embroidery data created according to an embroidery image such as a design drawing (S001). Then, the embroidery system acquires color data created according to the embroidery data (S002). Further, the embroidery system acquires roughness data corresponding to the embroidery data (S003). The embroidery system reads the acquired roughness data, extracts an area in which a degree of roughness is large, performs a process of changing a density of an embroidery design corresponding the extracted area in which the degree of roughness is large (S004).

The process of changing the density of the embroidery design in step S004 is a process of reducing the density of the embroidery design (reducing the density of stitches).

When the color data is set for each unit length of the thread used for the embroidery, the color data is to be modified in response to the change of the density of the embroidery design.

Accordingly, the embroidery system updates the embroidery data and the color data to the embroidery data and the color data that are modified according to the change of the density of the embroidery design (S005). The embroidery system performs thread coloring and embroidery according to the updated data (S006).

Figure 7C:
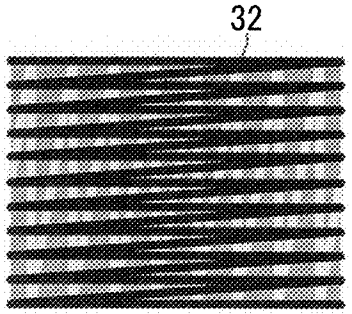
FIG. 7A, FIG. 7B, and FIG. 7C are schematic views for describing a state of a cloth after embroidery, according to an embodiment of the present disclosure.
Figure 7B:
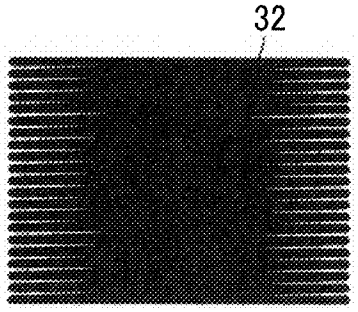
Figure 7A:
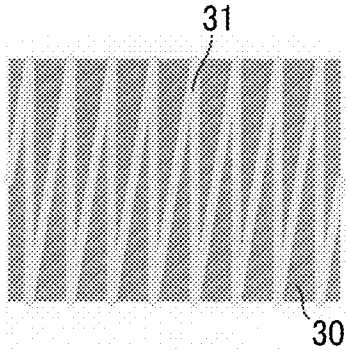

FIG. 7A to FIG. 7C are schematic views for describing a state of a cloth after embroidery.

FIG. 7A is a view for describing a state after underlay stitching. FIG. 7B and FIG. 7C are views each for describing a state in which embroidery of an embroidery design is performed after underlay stitching.

In typical embroidery, underlay stitching, which is embroidery for reinforcement, is performed to prevent a cloth 30 from being deformed in embroidery. For example, by first sewing (underlay-stitching) with a thread 31 as illustrated in FIG. 7A and then sewing an embroidery design with a thread 32 illustrated in FIG. 7B and FIG. 7C on the underlay stitching with the thread 31, deformation in the sewed embroidery design can be avoided or reduced.

FIG. 7C is a view of embroidery on which a process of reducing the density of the embroidery design (in other words, reducing the density of stitches) is performed in step S006 of the flow of the present embodiment illustrated in FIG. 6. By reducing the density of the embroidery design, the thread of the underlay stitching shows through as illustrated in FIG. 7C. This emphasizes the visual roughness impression of the embroidery design.

On the other hand, the process of changing the density of the embroidery design is not performed for an area in which the degree of roughness is small, so that the underlay stitching is hidden as illustrated in FIG. 7B.

Figure 8:
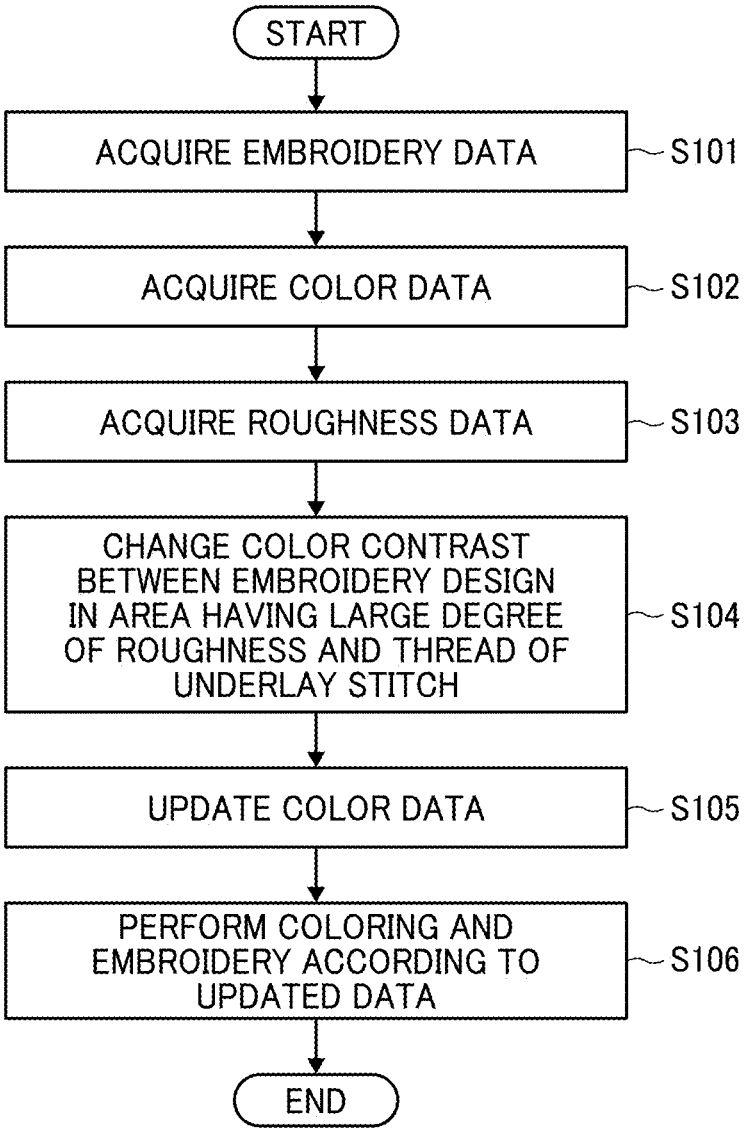
FIG. 8 is a flowchart illustrating an operation of the embroidery system in a second mode, according to an embodiment of the present disclosure.

FIG. 8 is a flowchart illustrating a second mode of a flow of embroidery by the embroidery system, according to the present embodiment.

First, the embroidery system acquires embroidery data created according to an embroidery image such as a design drawing (S101). Then, the embroidery system acquires color data created according to the embroidery data (S102). Further, the embroidery system acquires roughness data corresponding to the embroidery data (S103). The embroidery system reads the acquired roughness data, extracts an area in which a degree of roughness is large, performs a process of changing a contrast between a color a thread used for embroidery of an embroidery design corresponding to the extracted area in which the degree of roughness is large and a color of a thread used for underlay stitching (S104).

The process of changing the contrast in the step S104 is a process of increasing a contrast between the color of the thread used for the embroidery of the embroidery design and the color of the thread used for the underlay stitching.

Then, the embroidery system updates the color data to color data modified according to the change of the contrast (S105). The embroidery system performs thread coloring and embroidery according to the updated data (S106).

In changing the contrast between the colors of the threads, it is preferable to change the color of the thread for the underlay stitching without significantly changing the color of an area of the embroidery design so as not to affect the original design.

Further, as the process of changing the contrast, by increasing a difference in brightness between the color of the thread used for embroidery of the embroidery design and the color of the thread used for the underlay stitching, natural shadows can be formed.

On the other hand, the process of changing the contrast is not performed for an area in which the degree of roughness is small. In other words, for an area in which the degree of roughness is small, embroidery can be performed without providing a difference in the contrast between the color of the thread used for the embroidery of the embroidery design and the color of the thread used for the underlay stitching.

Figure 9:
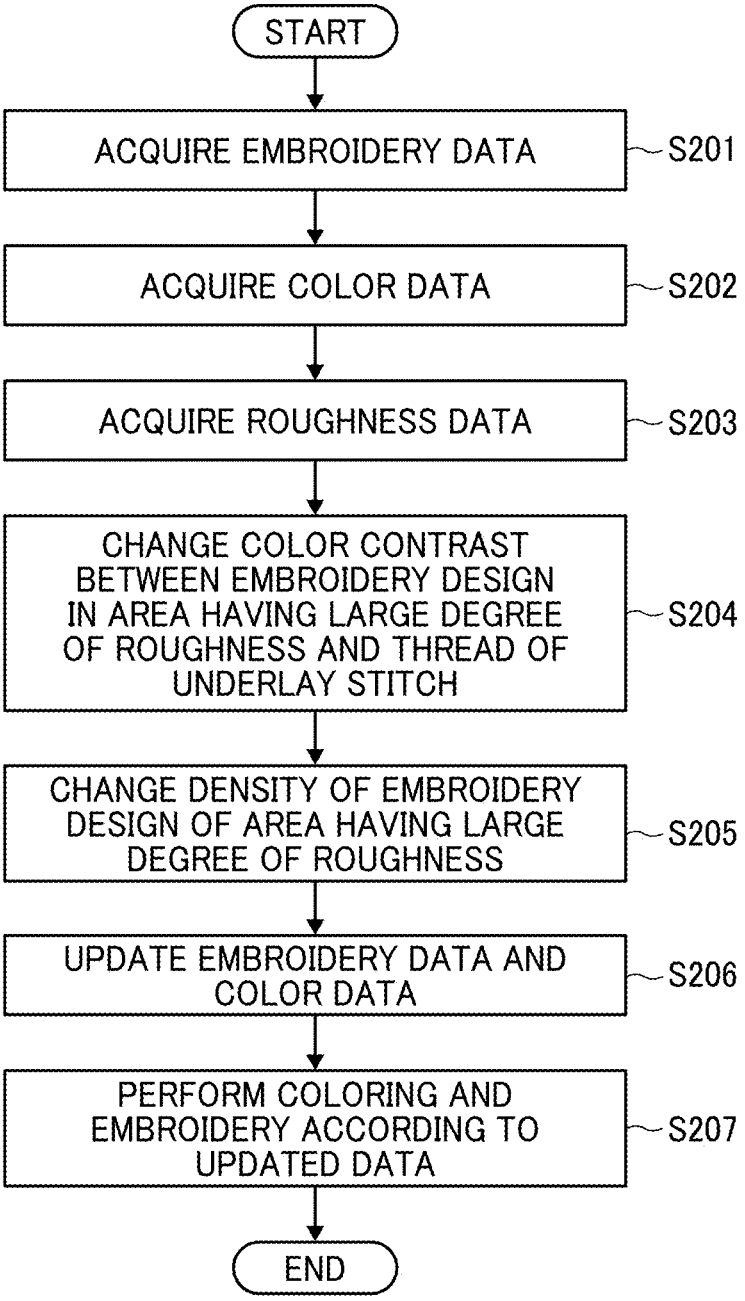
FIG. 9 is a flowchart illustrating an operation of the embroidery system in a third mode, according to an embodiment of the present disclosure.

FIG. 9 is a flowchart illustrating a third mode of a flow of embroidery by the embroidery system, according to the present embodiment.

First, the embroidery system acquires embroidery data created according to an embroidery image such as a design drawing (S201). Then, the embroidery system acquires color data created according to the embroidery data (S202). Further, the embroidery system acquires roughness data corresponding to the embroidery data (S203). The embroidery system reads the acquired roughness data, extracts an area in which a degree of roughness is large, performs a process of changing a contrast between a color a thread used for embroidery of an embroidery design corresponding the extracted area in which the degree of roughness is large and a color of a thread used for underlay stitching (S204).

The process of changing the contrast in the step S204 is a process of increasing a contrast between the color of the thread used for the embroidery of the embroidery design and the color of the thread used for the underlay stitching.

Further, the embroidery system performs a process of changing a density of the embroidery design corresponding to the extracted area in which the degree of roughness is large (S205).

The process of changing the density of the embroidery design in step S205 is a process of reducing the density of the embroidery design (reducing the density of stitches).

Next, the embroidery system updates the embroidery data and the color data to the embroidery data and the color data that are respectively modified according to the change in the contrast between the threads in step S204 and the change in the density of the embroidery design in step S205 (S206). The embroidery system performs thread coloring and embroidery according to the updated data (S207).

In changing the contrast between the colors of the threads, it is preferable to change the color of the thread for the underlay stitching without significantly changing the color of an area of the embroidery design so as not to affect the original design.

Further, as the process of changing the contrast, by increasing a difference in brightness between the color of the thread used for embroidery of the embroidery design and the color of the thread used for the underlay stitching, natural shadows can be formed.

On the other hand, the process of changing the contrast is not performed for an area in which the degree of roughness is small. In other words, for an area in which the degree of roughness is small, embroidery can be performed without providing a difference in the contrast between the color of the thread used for the embroidery of the embroidery design and the color of the thread used for the underlay stitching.

Figure 10A:
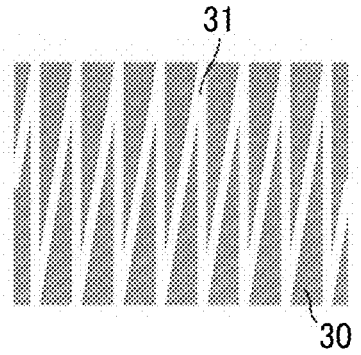
FIG. 10A and FIG. 10B are schematic views for describing a state of a cloth after embroidery, according to an embodiment of the present disclosure.
Figure 10B:
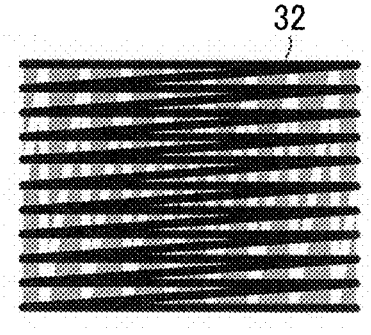

FIG. 10A is a view of an example in which the color of the thread used for underlay stitching is changed in step S204 of the flowchart of FIG. 9. FIG. 10B is a view of embroidery on which a process of reducing the density of the embroidery design (in other words, reducing the density of stitches) is performed in step S205 of the flowchart of FIG. 9.

According to the third mode described with reference to FIG. 9, since the process of increasing the contrast between the color of the thread used for the embroidery of the embroidery design and the color of the thread used for the underlay stitching and the process of reducing the density of the embroidery design are performed, an appearance is obtained in which the underlay stitching having a large contrast difference shows through. Thus, the visual roughness impression of the embroidery design is emphasized.

On the other hand, when the roughness impression is not to be emphasized, the embroidery density of the embroidery design is not changed or increased, and the same color is used for the color of the thread of the embroidery design and the color of the thread of the underlay stitching.

In a typical embroidery apparatus, since the number of colors of threads that can be mounted on the apparatus is limited, it is difficult to freely adjust the color of the thread used for embroidery of the embroidery design and the color of the thread used for underlay stitching. For this reason, it is preferable that the embroidery system includes a liquid discharge apparatus and has a configuration enabling coloring of a thread inline.

Currently, a system is known is known in the art that colors (dyes) a thread in different colors in a conveyance direction by using inkjet technologies and embroidery is performed by using the thread colored in a desired color.

Even when various types of embroidery are performed using threads colored in multiple colors by inkjet technologies, the texture (roughness) is provided by the threads themselves, and the resulting embroidery design is flat. For this reason, when an embroidery design is formed according to an embroidery image having a three-dimensional appearance, it is difficult to obtain an embroidery design in which a visual roughness impression is emphasized.

According to one aspect of the present disclosure, an embroidery system is provided that can impart a visual roughness to an embroidery design.

Aspects of the present disclosure are, for example, as follows.

Aspect 1

According to Aspect 1, an embroidery system includes a coloring means for coloring a thread and an embroidery means for performing embroidery of an embroidery design and underlay stitching.

The embroidery means uses the thread colored by the coloring means for at least one of the embroidery of the embroidery design and the underlay stitching.

The embroidery system includes an embroidery data creation means for creating data of the embroidery design and the underlay stitching according to an embroidery image.

The embroidery system includes a color data creation means for creating color data for coloring the thread.

The embroidery system includes a roughness data acquisition means for acquiring roughness data representing roughness impression of the embroidery image.

The embroidery system includes an embroidery density adjustment means for changing an embroidery density of the embroidery design according to the roughness data.

Aspect 2

According to Aspect 2, the embroidery system of Aspect 1 further includes a contrast adjustment means for changing a contrast between a color of the thread used for the embroidery of the embroidery design and a color of the thread used for the underlay stitching according to the roughness data.

Aspect 3

According to Aspect 3, in the embroidery system of Aspect 1 or Aspect 2, the roughness data acquisition means extracts an area in which a degree of roughness of the embroidery image is large.

The embroidery density adjustment means reduces the embroidery density of the embroidery design corresponding to the area in which the degree of roughness is large.

The contrast adjustment means increases the contrast between the color of the thread used for embroidery of the embroidery design corresponding to the area in which the degree of roughness is large and the color of the thread used for the underlay stitching.

Aspect 4

According to Aspect 4, in the embroidery system of Aspect 1 or Aspect 2, the roughness data acquisition means extracts an area in which a degree of roughness of the embroidery image is large.

The embroidery density adjustment means reduces the embroidery density of the embroidery design corresponding to the area in which the degree of roughness is large.

The contrast adjustment means increases a difference in brightness between the color of the thread used for embroidery of the embroidery design corresponding to the area in which the degree of roughness is large and the color of the thread used for the underlay stitching.

Aspect 5

According to Aspect 5, in the embroidery system of any one of Aspect 1 to Aspect 4, the roughness data is data of surface roughness acquired from a motif of the embroidery image.

Aspect 6

According to Aspect 6, in the embroidery system of any one of Aspect 1 to Aspect 4, the roughness data is data of a contrast of an image of the embroidery image.

Aspect 7

According to Aspect 7, in the embroidery system of any one of Aspect 1 to Aspect 4, the roughness data is data of a frequency of an image of the embroidery image.

Aspect 8

According to Aspect 8, in the embroidery system of any one of Aspect 1 to Aspect 4, the roughness data is set by a user.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. An embroidery system comprising:

a colorizer to color a thread;

an embroiderer to perform embroidery of an embroidery design and underlay stitching, the embroiderer being configured to use the thread colored by the colorizer for at least one of the embroidery of the embroidery design or the underlay stitching; and circuitry configured to:

create data of the embroidery design and the underlay stitching according to embroidery image data;

create color data for coloring the thread to be used for coloring the at least one of the embroidery of the embroidery design or the underlay stitching;

acquire roughness data representing roughness impression of the embroidery image data;

change an embroidery density of the embroidery design according to the roughness data;

extract an area in which a degree of roughness of the embroidery image data is larger than a reference degree;

reduce the embroidery density of the embroidery design corresponding to the area in which the degree of roughness is larger; and increase a contrast between a color of the thread used for embroidery of the embroidery design corresponding to the area in which the degree of roughness is larger and a color of the thread used for the underlay stitching.

2. The embroidery system of claim 1, wherein the circuitry is further configured to change a contrast between a color of the thread used for the embroidery of the embroidery design and a color of the thread used for the underlay stitching according to the roughness data.

3. The embroidery system of claim 1, wherein the roughness data is data of a contrast of an image of the embroidery image data.

4. The embroidery system of claim 1, wherein the roughness data is data of a frequency of an image of the embroidery image data.

5. The embroidery system of claim 1, wherein the roughness data is set by a user.

6. An embroidery system, comprising:

a colorizer to color a thread;

an embroiderer to perform embroidery of an embroidery design and underlay stitching, the embroiderer being to use the thread colored by the colorizer for at least one of the embroidery of the embroidery design or the underlay stitching; and circuitry configured to:

create data of the embroidery design and the underlay stitching according to embroidery image data;

create color data for coloring the thread to be used for coloring the at least one of the embroidery of the embroidery design or the underlay stitching;

acquire roughness data representing roughness impression of the embroidery image data;

change an embroidery density of the embroidery design according to the roughness data;

extract an area in which a degree of roughness of the embroidery image data is larger than a reference degree;

reduce the embroidery density of the embroidery design corresponding to the area in which the degree of roughness is larger; and increase a difference in brightness between a color of the thread used for embroidery of the embroidery design corresponding to the area in which the degree of roughness is larger and a color of the thread used for the underlay stitching.

7. The embroidery system of claim 6, wherein the circuitry is further configured to change a contrast between a color of the thread used for the embroidery of the embroidery design and a color of the thread used for the underlay stitching according to the roughness data.

8. The embroidery system of claim 6, wherein the roughness data is data of a contrast of an image of the embroidery image data.

9. The embroidery system of claim 6, wherein the roughness data is data of a frequency of an image of the embroidery image data.

10. The embroidery system of claim 6, wherein the roughness data is set by a user.

11. An embroidery system, comprising:

a colorizer to color a thread;

an embroiderer to perform embroidery of an embroidery design and underlay stitching, the embroiderer being to use the thread colored by the colorizer for at least one of the embroidery of the embroidery design or the underlay stitching; and circuitry configured to:

create data of the embroidery design and the underlay stitching according to embroidery image data;

create color data for coloring the thread to be used for coloring the at least one of the embroidery of the embroidery design or the underlay stitching;

acquire roughness data representing roughness impression of the embroidery image data; and change an embroidery density of the embroidery design according to the roughness data, wherein the roughness data is data of surface roughness acquired from a motif of the embroidery image data.

12. The embroidery system of claim 11, wherein the circuitry is further configured to change a contrast between a color of the thread used for the embroidery of the embroidery design and a color of the thread used for the underlay stitching according to the roughness data.

13. The embroidery system of claim 11, wherein the roughness data is data of a contrast of an image of the embroidery image data.

14. The embroidery system of claim 11, wherein the roughness data is data of a frequency of an image of the embroidery image data.

15. The embroidery system of claim 11, wherein the roughness data is set by a user.

* * * * *